United States Patent [19]

Cornelius et al.

[11] 4,426,841

[45] Jan. 24, 1984

[54] GAS TURBINE COMBUSTOR ASSEMBLY

[75] Inventors: Walter Cornelius, Troy; Edward D. Klomp, Mt. Clemens, both of Mich.

[73] Assignee: General Motors Corporation, Detroit, Mich.

[21] Appl. No.: 279,960

[22] Filed: Jul. 2, 1981

[51] Int. Cl.[3] ..... F02C 7/042

[52] U.S. Cl. ..... 60/39.23; 60/39.27; 60/39.29; 60/737; 60/748; 239/417

[58] Field of Search ..... 60/737, 748, 39.27, 60/39.23, 39.29, 738; 239/417, 403, 405, 406

[56] References Cited

U.S. PATENT DOCUMENTS

| | | | |
|---|---|---|---|
| 2,690,213 | 9/1954 | Collinson | 239/417 |
| 3,618,319 | 11/1971 | Kydd | 60/737 X |
| 3,648,457 | 3/1972 | Bobo | 60/748 X |
| 4,171,612 | 10/1979 | Zwick | 60/39.23 |
| 4,255,927 | 3/1981 | Johnson et al. | 60/39.23 |

*Primary Examiner*—Louis J. Casaregola

*Assistant Examiner*—Donald E. Stout

*Attorney, Agent, or Firm*—Saul Schwartz

[57] ABSTRACT

An improved gas turbine engine combustor assembly particularly for automotive application including a primary reaction chamber disposed in a pressurized air plenum of the engine, fixed area air flow ports between the reaction chamber and the plenum, a prechamber housing at an upstream end of the reaction chamber having an annular fixed area air passage between the plenum and the reaction chamber, a radially expandable annular partition in the air passage dividing the latter into an inner annular prechamber portion and an outer annular excess air portion, and a fuel nozzle operative to spray fuel into the prechamber portion where it vaporizes and mixes with air passing through the prechamber portion to provide a combustible mixture of properly lean air-fuel ratio in the combustor. The flow areas of the prechamber portion and the excess air portion vary in mutually inverse relationship and combine to always substantially equal the flow area of the air passage.

1 Claim, 4 Drawing Figures

GAS TURBINE COMBUSTOR ASSEMBLY

BACKGROUND OF THE INVENTION

This invention relates generally to gas turbine engines and, more particularly, to combustors adapted to minimize exhaust emissions.

A currently active area of gas turbine engine technology is exhaust emission control in automotive gas turbine applications. In particular, control of hydrocarbons (HC), carbon monoxide (CO) and oxides of nitrogen ($NO_x$) is essential. HC and CO can be held to acceptable concentrations by efficient and complete combustion. In simple diffusion flame combustors, where fuel is sprayed directly into the combustion or primary reaction chamber and burns essentially at the stoichiometric air-fuel ratio, HC and CO do not present problems. Stoichiometric combustion, however, results in maximum flame temperature and maximum $NO_x$ formation. To achieve lower $NO_x$ levels than those of the simple diffusion flame combustors, other combustor designs have been proposed wherein a lean fuel-air mixture burns completely but at a lower temperature where the level of $NO_x$ in the exhaust is acceptable. In this type of combustor, known as a prevaporization combustor, a lean fuel-air mixture is prepared in a premixing-prevaporization chamber, called a prechamber, wherein the amount of air entering the chamber is closely controlled in relation to the amount of fuel injected into the prechamber to maintain a desired fuel-air ratio. The fuel injected into the prechamber vaporizes in the controlled quantity of air and the lean mixture is conveyed into the primary reaction chamber of the combustor where it burns at the low temperature. While such solutions are known to be effective in $NO_x$ control, the combustor structure is complicated by the fact that the quantities of air and fuel admitted to the prechamber must be changed frequently because of the variable nature of the automotive operating cycle. In some heretofore proposed prevaporization combustors, systems of movable shutters and/or louvers have been provided on the prechamber and on the combustor to control the amount of air admitted to the prechamber and to divert more air from the primary reaction chamber to the prechamber at higher engine operating speeds. While such systems effectively control emissions they also develop undesirably high pressure drops across the combustor at high engine power levels and also introduce complicated control mechanisms not particularly suited to severe gas turbine combustor operating conditions. A gas turbine engine combustor according to this invention is an improvement over these and other heretofore known prevaporization type low emission combustors.

SUMMARY OF THE INVENTION

The primary feature, then, of this invention is that it provides an improved prevaporization type gas turbine engine combustor having low exhaust emission characteristics and simplified structure for durability and dependable operation. Another feature of this invention is that it provides an improved prevaporization type combustor wherein total cross sectional air flow area across the combustor is substantially constant over the entire engine operating range to reduce pressure drop across the combustor and wherein the flow area of the prechamber is variable by simple and efficient mechanical means located at a relatively cool portion of the combustor. Still another feature of this invention resides in the provision in the improved prevaporization type combustor of an air passage at the upstream end of the combustor, air flow control means for dividing the air passage into a variable flow area prechamber portion and a simultaneously variable flow area excess air portion which flow areas vary in inverse proportion, and fuel nozzle means for injecting fuel into the prechamber portion wherein it vaporizes and develops a desired air-fuel ratio. A still further feature of this invention resides in the provision in the air flow control means of a generally cylindrical partition disposed in the air passage at the upstream end of the combustor which partition is radially expandable and defines the variable area prechamber portion and the inversely variable area excess air portion, the fuel nozzle means being operative to spray fuel into the prechamber portion at a rate proportional to the power demand on the engine and the flow area of the prechamber portion to develop with the air passing through the prechamber portion a lean air-fuel mixture adapted for combustion with low exhaust emissions.

These and other features of this invention will be readily apparent from the following specification and from the drawings wherein.

Figure 1:
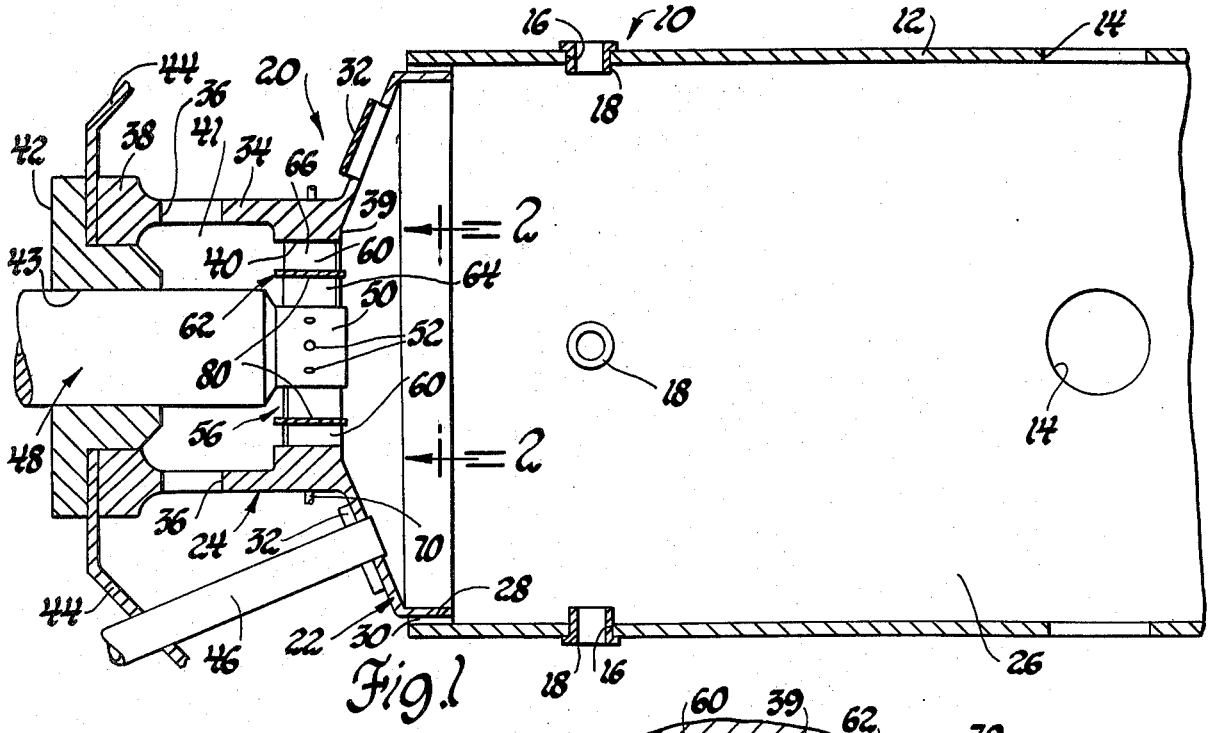
FIG. 1 is a sectional view of a gas turbine engine combustor according to this invention.

Referring now to FIG. 1 of the drawings, there shown in cross section is a prevaporization type gas turbine engine combustor according to this invention and designated generally 10 particularly adapted for automotive applications. In conventional fashion, the combustor 10 is disposed in a pressurized air plenum where the entire combustor is surrounded by pressurized air available for supporting combustion within the combustor, cooling the surface areas of the combustor, and diluting the products of combustion to achieve acceptable gas temperatures prior to exiting the combustor through a gasifier turbine nozzle, not shown. The air in the plenum surrounding the combustor 10 may be regeneratively heated in conventional manner.

With continued reference to FIG. 1, the prevaporization type combustor 10 includes a cylindrical wall portion 12 having a plurality of circumferentially disposed air ports 14 at the right end of the combustor and a similar plurality of air ports 16 near the left end. Each of the air ports 16 has a liner or grommet 18 mounted therein for directing the air flow through the ports. At the left or upstream end of the combustor 10 is situated a dome and prechamber assembly 20 including a generally conical dome 22 and an integral prechamber housing 24. The dome and prechamber assembly 20 cooperates with the combustor wall portion 12 in defining a primary reaction chamber 25 wherein combustion occurs and from which the products of combustion escape through nozzle means, not shown, at the right end of the combustor.

The dome 22 has a generally cylindrical skirt 28 at which the dome attaches to the wall portion 12 by conventional means, as by welding. The skirt 28 includes a plurality of waffle portions defining cooling air slots 30 communicating between the plenum and the reaction chamber 26. The slots 30 are oriented parallel to the wall portion 12 so that jets of pressurized relatively cool air from the plenum enter the primary reaction chamber along the wall to cool the latter in well known fashion. Similarly, the dome 22 includes a plurality of louvers 32 which communicate between the plenum and the reaction chamber and direct jets of cooling air along the internal surface of the dome.

Figure 2:
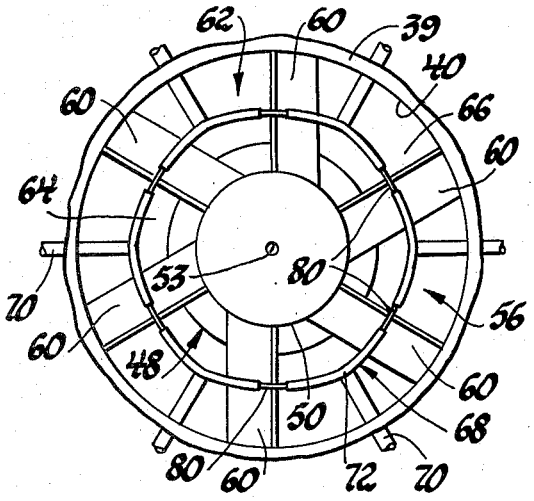
FIG. 2 is an enlarged view taken generally along the plane indicated by lines 2—2 in FIG. 1.

As seen best in FIGS. 1 and 2, the prechamber housing 24 is generally cup shaped and includes a cylindrical wall 34 having a plurality of air ports 36 therethrough, an annular rim 38 at the end of wall 34, and a circular base 39 at which the prechamber housing merges with the dome 22. A cylindrical bore 40 through the base 39 of the housing 24 exposes a central chamber portion 41 of the housing to the primary reaction chamber. A plug or closure 42 having a bore 43 therethrough is disposed over the open end of the housing and cooperates with the rim 38 in capturing therebetween a support 44 which is connected to the remainder of the engine structure, not shown. A conventional electric igniter 46 is mounted on the support 44 and projects through the dome 22 into the primary reaction chamber 26.

With continued reference to FIGS. 1 and 2, a fuel nozzle 48 is supported in the bore 43 in closure 42 and includes a reduced diameter portion 50 which projects into the cylindrical bore 40 generally to the right extremity of the prechamber housing, FIG. 1. The fuel nozzle includes a plurality of radially directed delivery ports 52 at the reduced diameter portion and, optionally as described more fully hereinafter, a delivery port 53 at the innermost end adapted to spray fuel directly into the reaction chamber 26. The reduced diameter portion 50 of the nozzle thus cooperates with the bore 40 in defining an annular air passage 56 between the central chamber portion 41 in the prechamber housing and the reaction chamber 26. An annular cascade of swirler vanes 60 is disposed in the air passage 56 with each vane being rigidly attached at a radially outer end to the prechamber housing and at a radially inner end to the fuel nozzle. Air flowing through the ports 36 and the central chamber portion 41 is swirled in conventional fashion by the vanes 60 as it flows through annular air passage 56 and into the reaction chamber 26. Further, the fuel delivery ports 52 on the small diameter portion 50 of the nozzle are generally centrally located between the vanes and about midway along the axial length of the air passage 56.

Figure 3:
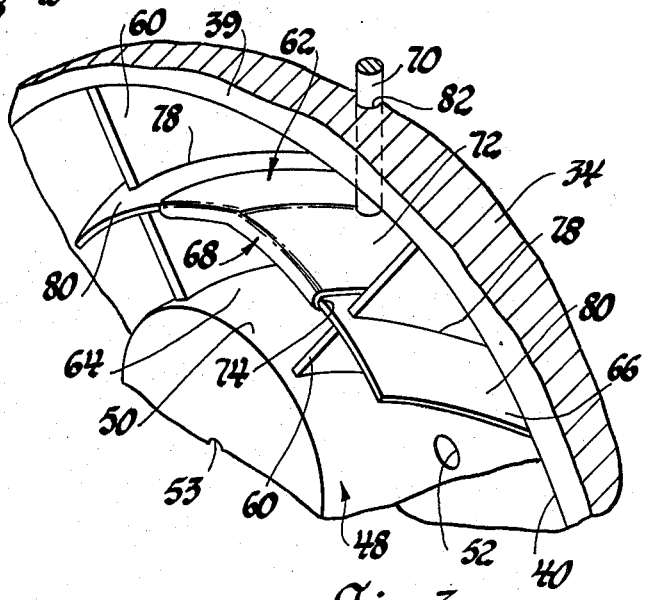
FIG. 3 is an enlarged perspective view of a portion of FIG. 2 illustrating details of the partition assembly.
Figure 4:
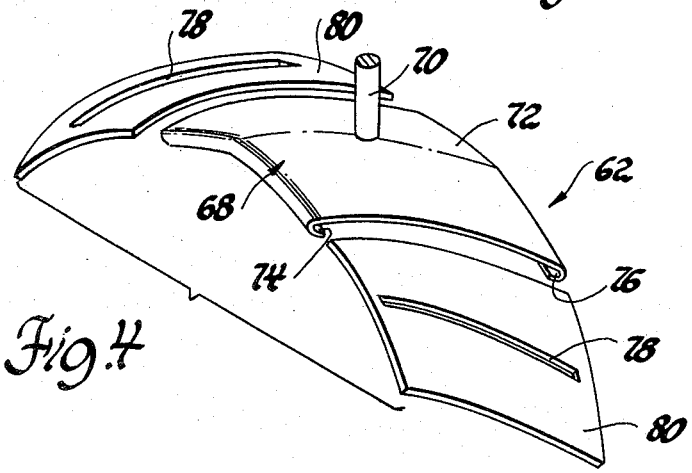
FIG. 4 is an exploded perspective view of a portion of FIG. 3.

As seen best in FIGS. 2, 3 and 4, air flow area control means in the form of a partition assembly 62 disposed within the annular air passage 56 and around each of the swirler vanes 60 functions to divide the air passage into an inner annular prechamber portion 64 and an outer annular excess air portion 66. The partition assembly 62 includes a plurality of generally T-shaped control elements 68 disposed in the spaces between the vanes 60, each of the control elements including a shaft 70 rigidly attached to a guide 72. Each guide has a first edge track 74, FIGS. 3 and 4, defined by an inturned flange portion and a second edge track 76 defined by a similar inturned flange. Each of the swirler vanes 60 is slidably received in an appropriately shaped slot 78 in a radially slidable partition element 80. One edge of each partition element 80 is slidably received between the first and second edge tracks 74 and 76 on a corresponding one of the control elements 68 disposed between the swirler vanes. Similarly, the opposite edge of each partition element 80 is slidably received between the first and second edge tracks 74 and 76 on the corresponding one of the control element 68 adjacent that edge. Each of the control element shafts 70 is received in a bore 82, FIG. 3, in the cylindrical wall 34 of the prechamber housing 24. The shafts are radially slidable in the bores so that the control elements 68 are radially displaceable from positions near the fuel nozzle to positions near the wall of bore 40. The sliding connection between each of the guides and corresponding ones of the partition elements effects concurrent radial displacement of each of the partition elements along the lengths of the swirler vanes 60 so that flow areas of the prechamber portion and the excess air portion are simultaneously variable, the sum of the flow areas being substantially equal to the flow area of the annular air passage 56 and each varying in inverse proportion to the other upon movement of the shafts 70.

Proceeding now to a description of the operation of the combustor 10, in prevaporization type combustors the desired low exhaust emission levels depend upon introduction of a properly lean intimate mixture of air and vaporized fuel into the primary reaction chamber prior to the occurrence of combustion. For any arbitrarily chosen air-fuel ratio, delivery of the properly constituted intimate mixture depends upon synchronizing fuel delivery with the volume of air passing through the prechamber which volume depends upon the cross sectional flow area of the prechamber. These principles are, of course, well known and to this end fuel control means, not shown, are provided for the combustor 10 which fuel control means are calibrated to the particular engine in which the combustor is installed. The fuel control means receive an input proportional to power demand and automatically determine the quantities of fuel and combustion air required to provide the desired power at the preselected lean air-fuel ratio. In the embodiment of FIGS. 1 through 4, the control means automatically regulate the fuel pressure and the cross sectional flow area of the prechamber to maintain the desired power output at the desired lean air-fuel ratio.

With respect now specifically to FIGS. 1 2 and 3, under steady state operating conditions a flame front is established in the reaction chamber 26 which is sustained by a continuous supply of intimately mixed fuel vapor and air. For the power level demanded at the steady state condition the control means determines the quantity of fuel to be supplied and delivers it at the proper rate to the orifices 52. Simultaneously, the control means determines the necessary combustion air flow rate and, through connection with the shafts 70, effects radial positioning of the guides 68 and partition elements 80 to define an annular prechamber portion 64 having the required cross sectional flow area. The fuel then issues from the orifices 52 into the air stream coming from ports 36 and central chamber portion 41 and passing through the prechamber portion 64 and commences vaporization as it is swept downstream toward the flame front in the reaction chamber in a swirl pattern developed by the vanes 60. Excess air not needed for combustion flows through the excess air portion 66 around the prechamber portion and is swirled by the vanes 60 around the cloud of fuel-air mixture developed in the prechamber but without significant mixing therewith so that the air-fuel ratio is not upset. The excess air combines with the air delivered through the ports 15 and 16, the slots 30 and the louvers 32 to stabilize the flame front, cool the combustor wall portion and the dome, and dilute the products of combustion.

When a signal to change engine power is received, as for example when the engine is idled, the fuel control means again automatically adjusts the fuel delivery rate and the guides 68 and partition elements 80 to reflect the decreased fuel and combustion air requirements. For reduced combustion air requirements the guides 68 are projected radially inward to reduce the flow area of the prechamber portion 64 while simultaneously increasing the flow area of the excess air portion 66 in inverse proportion. Conversely, when increased power demand is signaled the movement of the guides 68 is reversed so that the flow area of the prechamber portion 64 increases while the flow area of the excess air portion 66 decreases, again in inverse proportion. Obviously, however, since the ports 14 and 16 and the louvers 32 and the slots 30 are of fixed cross sectional area and the sum of the flow areas of the prechamber portion and the excess air portion are constant, the total cross sectional air flow area across the combustor is also constant so that a substantially constant pressure drop across the combustor is maintained regardless of engine power requirement.

The final operating condition not yet described is initial start-up or light-off of the combustor. Since it is known that lean air-fuel ratio mixtures are difficult to ignite initially, the nozzle 48 includes the capability described earlier to inject fuel directly into the reaction chamber 26 from fuel port 53. In this situation the combustor initially functions as a conventional diffusion flame combustor wherein the initial fuel-air mixture is ignited by the igniter 46 and burns briefly at the stoichiometric air-fuel ratio. However, as soon as a stable flame front is established the direct injection of fuel is terminated and the properly lean air-fuel mixture is developed as described hereinbefore. Alternatively, of course, the fuel control means could be scheduled to provide extra fuel at the orifices 52 to initially enrich the air-fuel mixture for easier starting followed by return to the lean mixture as described.

The embodiments of the invention in which an exclusive property or privilege is claimed are defined as follows:

1. In a gas turbine engine having a pressurized air plenum and a combustor assembly disposed in said plenum including wall means having a plurality of fixed flow area ports between said plenum and a reaction chamber defined by said wall means, the combination comprising means on said combustor assembly defining at an upstream end thereof an annular air passage between said plenum and said reaction chamber having a plurality of generally radially extending swirl inducing vanes therein, a radially adjustable cylindrical partition disposed in said air passage between said swirl inducing vanes operative to divide said air passage into an outer annular excess air portion and an inner annular prechamber portion, the flow areas of said excess air portion and said prechamber portion varying in mutually inverse relationship and combining to always be substantially equal to the flow area of said air passage, means on said combustor assembly operative to adjust and maintain the radial position of said cylindrical partition thereby to simultaneously vary in mutually inverse relationship the flow area of each of said prechamber portion and said excess air portion, and a fuel nozzle disposed on said combustor assembly including a plurality of fuel ports operative to inject fuel into said prechamber portion for vaporization and combination with air flowing therethrough to provide a combustible mixture in said reaction chamber of properly lean air-fuel ratio for low emission combustion.

* * * * *